US010751900B2

(12) United States Patent
Einloft-Velte et al.

(10) Patent No.: US 10,751,900 B2
(45) Date of Patent: Aug. 25, 2020

(54) PROVIDING A CUTTING AREA WITH WEB-LIKE INTERLEAVER MATERIAL

(71) Applicant: Weber Maschinenbau GmbH Breidenbach, Breidenbach (DE)

(72) Inventors: Tobias Einloft-Velte, Dautphetal (DE); Thomas Nispel, Dautphetal (DE); Noël Ritzen, Siegen (DE)

(73) Assignee: WEBER MASCHINENBAU GMBH BREIDENBACH (DE)

( * ) Notice: Subject to any disclaimer, the term of this patent is extended or adjusted under 35 U.S.C. 154(b) by 0 days.

(21) Appl. No.: 16/025,655

(22) Filed: Jul. 2, 2018

(65) Prior Publication Data

US 2019/0030743 A1 Jan. 31, 2019

(30) Foreign Application Priority Data

Jul. 3, 2017 (DE) ..... 10 2017 114 758
Aug. 18, 2017 (DE) ..... 10 2017 118 930

(51) Int. Cl.
*B26D 7/32* (2006.01)
*B26D 7/27* (2006.01)
(Continued)

(52) U.S. Cl.
CPC ..... *B26D 7/325* (2013.01); *B26D 7/27* (2013.01); *B26D 7/32* (2013.01); *B65H 35/08* (2013.01); *B26D 1/12* (2013.01); *B26D 2210/02* (2013.01)

(58) Field of Classification Search
CPC ..... B26D 2210/02; B26D 1/565; B26D 7/32; B23D 33/04; B65H 39/16;
(Continued)

(56) References Cited

U.S. PATENT DOCUMENTS 1,607,552 A * 11/1926 Maze ..... D21H 17/60
162/172
1,762,930 A * 6/1930 Manson ..... D21H 17/22
162/172
(Continued)

FOREIGN PATENT DOCUMENTS

DE 102011106459 A1 1/2013
DE 102012009648 A1 11/2013
(Continued)

OTHER PUBLICATIONS

Official Communication received from the European Patent Office for related European Patent Application No. 18181280.1; dated Nov. 15, 2018; 8 pages.
(Continued)

*Primary Examiner* — Sean M Michalski
(74) *Attorney, Agent, or Firm* — Dickinson Wright PLLC

(57) ABSTRACT

The invention relates to an apparatus for a multitrack provision of web-like interleaved sheet material at a cutting region in which products supplied on multiple tracks are simultaneously cut into slices and interleaved sheets are introduced which are cut off from the provided interleaved sheet material in the cutting region, having a material store which comprises a rotatably supported material roll for each track; and having a removal device which is configured for a rolling off of material webs individually per track from the material rolls.

26 Claims, 3 Drawing Sheets

Figure 1:
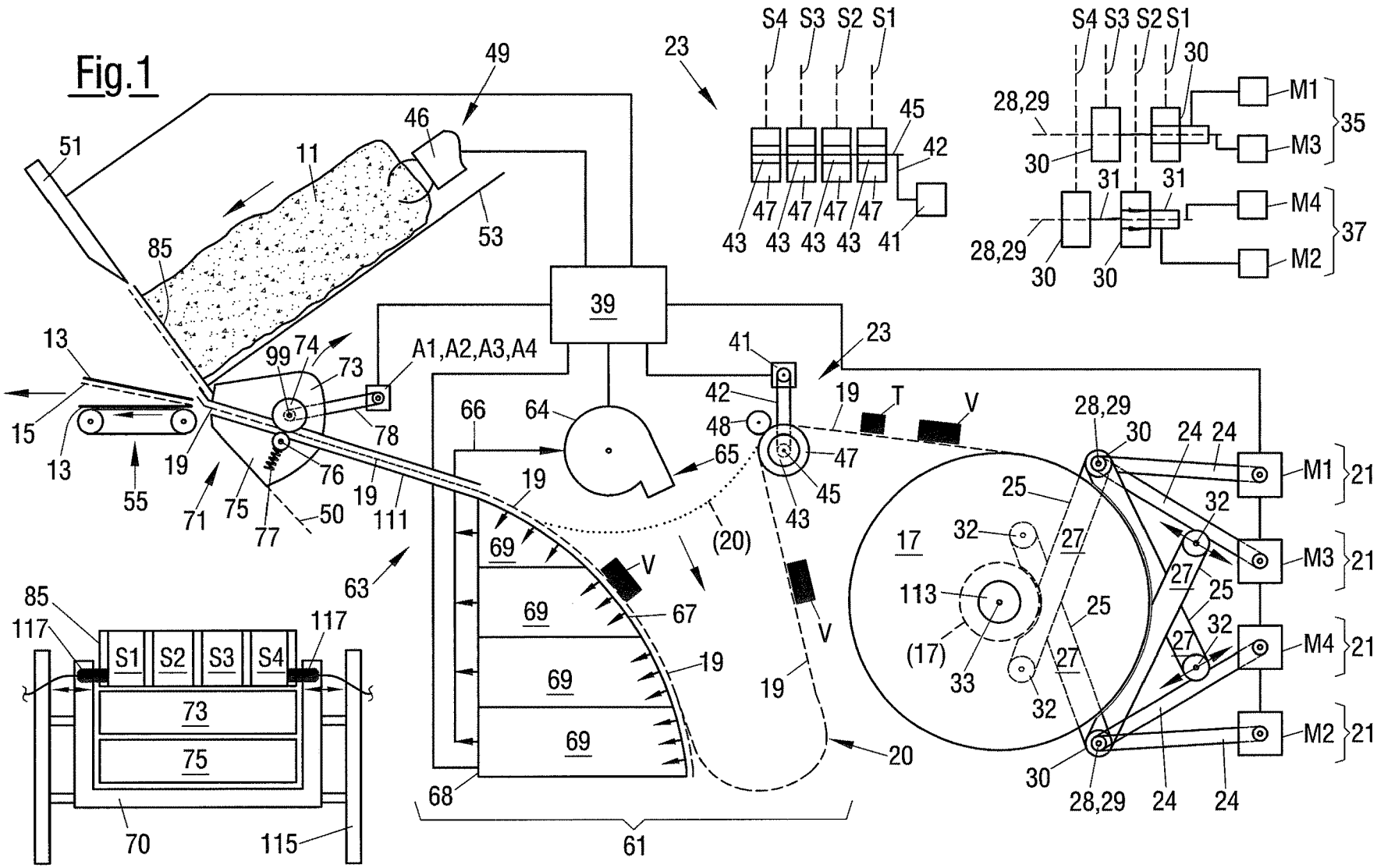

(51) Int. Cl.
*B65H 35/08* (2006.01)
*B26D 1/12* (2006.01)

(58) Field of Classification Search
CPC ..... B65H 2403/7253; B65H 2301/412845; B65H 2408/217; B65H 20/32; B65H 2408/215
See application file for complete search history.

(56) References Cited

U.S. PATENT DOCUMENTS 1,937,412 A * 11/1933 Roesen ..... B65H 23/08 242/420.2
1,942,438 A * 1/1934 Manson ..... D21H 17/06 162/172
2,142,986 A * 1/1939 Bishop, Jr. ..... D21H 17/09 162/172
2,343,065 A * 2/1944 Kumler ..... D21H 17/31 106/271
2,637,665 A * 5/1953 Dodge ..... D21H 17/60 162/172
3,241,968 A * 3/1966 Garth ..... D21H 23/765 430/538
3,422,653 A 1/1969 Wiig
3,525,668 A * 8/1970 Goldstein ..... D21H 17/35 162/169
3,558,070 A * 1/1971 Gabriels ..... B65H 19/2238 242/523.1
3,586,006 A * 6/1971 Wendt ..... A24C 5/20 131/280
3,675,387 A * 7/1972 Lekan ..... B65B 25/08 53/157
3,697,146 A * 10/1972 Boisen ..... A47K 10/36 242/564.1
3,711,314 A * 1/1973 Campbell ..... D06M 11/57 427/301
3,741,079 A * 6/1973 Bossons ..... B31F 5/027 493/350
3,772,040 A * 11/1973 Benson ..... B65B 25/08 426/420
3,787,001 A * 1/1974 Henry ..... B65B 9/213 242/417.2
3,848,757 A * 11/1974 Jordan ..... B65B 35/28 414/802
3,861,612 A * 1/1975 Kubo ..... B65H 9/18 242/555.6
3,874,968 A * 4/1975 Robinson ..... B29C 66/032 156/154
3,886,030 A * 5/1975 Hurst ..... B65H 19/1831 156/504
3,985,932 A * 10/1976 Porter ..... D21H 19/36 428/326
3,990,647 A * 11/1976 Clifford ..... B65H 19/18 242/563.2
3,994,449 A * 11/1976 Wales ..... B65H 19/18 242/563.2
4,116,399 A * 9/1978 Mosburger ..... B65H 19/1852 156/504
4,176,000 A * 11/1979 Achelpohl ..... B29C 65/18 156/510
4,322,802 A * 3/1982 Lewis, Jr. ..... B41F 33/00 26/98
4,371,553 A * 2/1983 Gilling ..... B65D 75/38 229/87.11
4,375,482 A * 3/1983 Maroszek ..... B65D 75/54 229/87.11
4,487,657 A * 12/1984 Gomez ..... D21H 21/34 162/158
4,919,724 A * 4/1990 Cenisio ..... D21H 17/07 106/162.5
4,944,467 A * 7/1990 Snygg ..... B65H 23/06 242/422.9
5,117,717 A * 6/1992 Mally ..... B26D 5/20 53/157
5,137,225 A * 8/1992 Biagiotti ..... B65H 19/2269 242/521
5,160,484 A * 11/1992 Nikoloff ..... D21H 17/35 162/158
5,326,041 A * 7/1994 Alexander, III ..... B65H 16/106 242/563
5,456,800 A * 10/1995 Tansley ..... D21H 17/15 162/158
5,695,608 A * 12/1997 Yagi ..... D21H 19/40 162/135
5,834,076 A * 11/1998 Ferrero ..... A22C 13/0013 428/34.8
5,858,173 A * 1/1999 Propst, Jr. ..... D21H 17/37 162/164.1
5,865,953 A * 2/1999 Rottger ..... D21F 11/00 162/135
5,979,308 A * 11/1999 Kagi ..... B41F 19/068 101/27
5,989,696 A * 11/1999 McCarthy ..... B32B 27/12 427/356
6,263,640 B1 * 7/2001 Handel ..... B65B 25/08 53/156
6,852,198 B1 * 2/2005 Yamazaki ..... D21H 17/72 106/236
7,189,308 B2 * 3/2007 Feit ..... D21H 27/10 162/135
7,424,903 B2 * 9/2008 Kagi ..... B41F 19/068 156/459
7,601,375 B2 * 10/2009 Langton ..... B65D 57/00 426/106
8,361,278 B2 * 1/2013 Fike ..... D21H 13/08 162/146
9,981,400 B2 * 5/2018 Dreier ..... B26D 7/325
2002/0179767 A1 * 12/2002 Rapparini ..... B65H 20/32 242/417.1
2004/0091585 A1 * 5/2004 Theisen ..... B65D 75/00 426/124
2008/0250944 A1 * 10/2008 Pryor ..... B26D 7/27 99/537
2012/0073249 A1 * 3/2012 Pryor ..... B26D 7/325 53/514
2016/0272440 A1 * 9/2016 Mayer ..... B65G 15/50
2016/0286852 A1 * 10/2016 Gindrat ..... B65H 19/1852
2016/0316770 A1 * 11/2016 van Blokland ..... A21C 14/00
2016/0346951 A1 * 12/2016 Horberg ..... B26D 7/325
2017/0165712 A1 * 6/2017 Fischer ..... B29D 7/01
2017/0165858 A1 * 6/2017 Bochtler ..... B26D 1/0006
2017/0259448 A1 * 9/2017 Weber ..... B26D 7/0625
2017/0266831 A1 * 9/2017 Wachter ..... B26D 9/00
2017/0368707 A1 * 12/2017 Keller ..... B26D 7/01
2018/0111283 A1 * 4/2018 Klockow ..... B26D 7/0641
2018/0169888 A1 * 6/2018 Weber ..... B26D 7/32
2019/0022885 A1 * 1/2019 Einloft-Velte ..... B26D 1/565
2019/0022886 A1 * 1/2019 Einloft-Velte ..... B26D 1/565
2019/0023518 A1 * 1/2019 Gerhardt ..... B65H 35/08
2019/0030743 A1 * 1/2019 Einloft-Velte ..... B26D 7/325
2019/0047168 A1 * 2/2019 Bialy ..... A22C 17/0093
2019/0152084 A1 * 5/2019 Schmeiser ..... B26D 5/007
2019/0152085 A1 * 5/2019 Reisz ..... B65H 16/021
2019/0232512 A1 * 8/2019 Votava ..... B26D 1/245
2019/0232513 A1 * 8/2019 Erne ..... B26D 7/0616

FOREIGN PATENT DOCUMENTS

DE 102013204956 A1 9/2014
DE 102013216717 A1 2/2015
EP 2671829 A2 12/2013
EP 2848380 A1 3/2015

(56) References Cited

FOREIGN PATENT DOCUMENTS

| | | | |
|---|---|---|---|
| WO | 2012024673 | A2 | 2/2012 |
| WO | 2016166286 | A1 | 10/2016 |

OTHER PUBLICATIONS

Official Communication from the German Patent and Trademark Office for related German Patent Application No. 102017118930.0; dated Jul. 26, 2018; 2 pages.

* cited by examiner

PROVIDING A CUTTING AREA WITH WEB-LIKE INTERLEAVER MATERIAL

CROSS-REFERENCES TO RELATED APPLICATIONS

This application claims the priority of German Application No. 102017114758.6 filed on Jul. 3, 2017 and German Application No. 102017118930.0 filed on Aug. 18, 2017, each of which is incorporated herein by reference, in their entirety.

The invention relates to an apparatus for a single-track or multitrack provision of web-like interleaved sheet material at a cutting region in which supplied products are cut into slices and interleaved sheets are introduced which are cut off from the provided interleaved sheet material in the cutting region.

In the cutting region, slices cut off from the products can consequently be provided with the interleaved sheets introduced into the cutting region. In this respect, either interleaved sheets can e.g. be introduced between a respective two directly consecutive slices or interleaved sheets can be introduced beneath a respective slice and thus between this slice and a support surface of this slice. A respective interleaved sheet is then, for example, located beneath the lowest slice of a portion on the formation of portions from a plurality of slices. Such a function which is also called an underleaver function, however, does not preclude that, on the formation of portions, a respective interleaved sheet is not only disposed beneath the lowest slice, but one or more interleaved sheets are also introduced between a respective two consecutive slices within the portion. Independently of whether an underleaver function is provided or not, a respective interleaved sheet can generally be introduced within a portion either between each pair of directly consecutive slices or only between one or more pairs of directly consecutive slices, e.g. between every nth pair, where n>1.

Such apparatus are generally known in the field of the slicing of food products and are also called interleavers or underleavers. An interleaver can in this respect—as mentioned above—also perform an underleaver function and vice versa. The present disclosure therefore not only applies to the interleavers primarily explained here or to the provision of interleaved sheets or interleaved sheet material between a respective two directly consecutive slices, but also to so-called underleavers which serve to place a sheet beneath products. It is ensured by such an underleaved sheet feed that at least the total lower side of the products does not directly lie on a support surface, for example, on a conveying device. When only the term "interleaver" is used in each case in the following, the respective statements and the respective disclosure—where sensible—will also apply to an "underleaver". As already mentioned, one and the same apparatus for the provision of interleaved sheet material or of interleaved sheets can perform both an interleaver function and an underleaver function in dependence on the respective application, i.e. an interleaver is simultaneously also an underleaver, and vice versa, within the framework of this disclosure.

The invention also relates to an apparatus for slicing food products, having a product feed which supplies products to be sliced to a cutting region in which a cutting blade moves in a rotating and/or revolving manner to cut the supplied products into slices; and having an interleaver or underleaver in accordance with the invention.

Such cutting apparatus are also called slicers or high-speed slicers, the latter against the background that bar-like or loaf-like food products can e.g. be sliced by such machines at high cutting speeds of several hundred to some thousand slices per minute. In many applications, stacked or overlapping portions are, for example, formed from the cut-off slices falling onto a support surface e.g. formed by a portioning belt. An interleaver, for example, serves to introduce interleaved sheets between directly consecutive slices of a portion so that the slices can later be separated from one another more easily. Paper or a plastic film, for example, serves as the material for the interleaved sheets.

In accordance with the progress in the development of cutting machines, in particular with respect to speed, accuracy and variety, ever higher demands are also made on the interleavers or underleavers. Known interleaver or underleaver concepts which generally provide satisfactory results frequently no longer meet these increased demands.

There is consequently a need for an improved interleaver or underleaver technology in particular in the field of the slicing of food products by means of high-speed slicers. In particular the operation of interleavers and underleavers on multiple tracks and individually per track is more and more in the foreground.

It is, for example, a problem of the known interleavers or underleavers that a multitrack slicing of food products and in this respect a product feed individually per track are becoming increasingly more important and interleavers or underleavers that are operable individually per track are not as powerful as would be desirable for an ideal adaptation of the interleaver or underleaver operation to the cutting operation on individual tracks.

It is the object of the invention to improve an apparatus for the provision of web-like interleaved sheet material to the extent that a more powerful operation individually per track is possible, in particular in conjunction with a multitrack slicing of food products by means of a high-speed slicer.

This object is satisfied by the features of the independent claims.

Provision is made in accordance with an aspect of the invention that the apparatus is configured for a multitrack provision of web-like interleaved sheet material and has a material store which comprises a rotatably supported material roll for each track, wherein a removal device is provided which is configured for a rolling off of material webs individually per track from the material rolls.

The apparatus in accordance with the invention, which will also simply be called an interleaver and/or an underleaver in the following, can consequently continuously work with a separate material web in each track. It is thus not necessary to produce a plurality of individual material webs from a starting material web within the interleaver. This aspect of the invention starts at the material store itself and thus at the "source" of the material webs. This enables a handling of the individual material webs individually per track in a continuous manner. The handling of each material web can consequently be ideally coordinated with the demands of the corresponding track of a slicer which correspondingly works on multiple tracks.

Advantageous embodiments of the invention are set forth in the dependent claims, in the description and in the drawing.

The removal device can comprise a roll-off drive for each track, said roll-off drive being in form-fitted engagement or force-transmitting engagement with the material roll or with the wound material web in an active state.

The configuration of the roll-off drives each as friction drives which are in frictional engagement with the wound material web in an active state is particularly advantageous. It is hereby not necessary to drive the material roll e.g. about its axis of rotation for the rolling off of the material web. It is additionally of advantage that the friction drive can engage at the outer periphery of the material roll such that the web length rolled off per time unit is only dependent on the speed of the friction drive, but not on the current diameter of the material roll. Furthermore, the friction drive can remain in frictional engagement with the material roll when stationary, that is when temporarily no web length is to be rolled off, and can thus serve as a brake for the material roll in order to prevent a further rotation of the material roll caused by inertia.

Provision is made in accordance with a particularly advantageous embodiment that the friction drives are controllable such that they remain in frictional engagement with the wound material web after a transition from a driving state into a non-driving state.

The friction drive can comprise a friction wheel, an arrangement of a plurality of friction wheels, or at least one revolving friction belt whose one run cooperates with the wound material web.

The roll-off drive can be changed into a passive state in which the roll-off drive is out of engagement with the wound material web.

A preferred embodiment provides that the roll-off drive comprises a pivotable drive arm. The pivot movements of the drive arms can e.g. each be implemented by means of a pneumatic cylinder.

The pivot axis of the drive arm preferably coincides with an axis of rotation of a drive shaft for a drive member of the drive arm.

In accordance with a preferred embodiment, pivot axes offset in parallel from one another are provided for the drive arms of the individual tracks. It is consequently not absolutely necessary to arrange the drive arms of all the tracks at a common pivot axis. The division of the drive arms onto a plurality of pivot axes enables a particularly space-saving arrangement of the individual roll-off drives within the interleaver.

The material rolls of the individual tracks are preferably rotatably supported about a common axis of rotation, wherein the pivot axes of the drive arms are disposed on a circle about the common axis of rotation. This concept enables a symmetrical design and the use of components of the same construction for the individual roll-off drives. If the material rolls of the individual tracks are seated next to one another on the common axis of rotation, all the material webs have the same geometrical starting situation, which simplifies the further handling of the individual material webs on their way to the cutting region.

Provision can furthermore be made that the drive arms of the individual tracks are combined pair-wise or group-wise and a common pivot axis is provided for each pair or for each group.

A comparatively simple drive concept can be implemented if the drive arms of the individual tracks are combined pair-wise or group-wise in accordance with a further embodiment and a coaxial shaft drive is provided for each pair or for each group and comprises a plurality of drive shafts which are disposed coaxially in one another and which are associated with a respective one of the drive arms.

A further possible embodiment of the invention according to which all the drive arms can be pushed onto their respective drive shaft from the same side of the apparatus for assembly or dismantling is in particular advantageous with respect to cleaning, servicing and conversion. The interleaver or underleaver in accordance with the invention hereby only needs to be accessible from one side, namely from the operating side of the interleaver or underleaver, or of the slicer to which the interleaver or underleaver respectively belongs, which is "preferred" with respect to the total design of the interleaver or with respect to the starting situation on site.

A pivot drive which comprises a piston-in-cylinder arrangement can be provided for each drive arm. The pivot drive can be configured to pretension the roll-off drive into engagement with the material roll or with the wound material web during a roll-off operation.

An ideal use of the construction space available in the interleaver or underleaver can be achieved if a belt drive comprising a drive motor arranged offset from a drive shaft is provided for each roll-off drive in accordance with a further development.

Provision is furthermore preferably made that the roll-off rates of the individual material webs can be changed by changing the drive speed of the roll-off drive when the respective roll-off drive remains in engagement with the material roll or with the wound material web.

An internal or external control device is preferably provided which is configured to control the removal of the individual material webs by an operation of the individual roll-off drives individually per track.

In accordance with a further preferred embodiment of the invention, a conveying device is provided which has a common drive for all the material webs and a separate clutch for each material web.

The conveying device can consequently be designed comparatively simply and inexpensively since only a single drive is necessary and the operation of the conveying device individually per track is implemented by the individual clutches which can be passive components that do not require an active control.

The clutch can be a clutch which engages automatically in dependence on force or on torque, in particular a slip clutch. The clutch can in particular be configured as a magnetic clutch.

The clutch can preferably be set to different threshold values for the force transmission or for the torque transmission. The conveying device can hereby be adapted to the respective demands, for example, to a respective set cutting program of the slicer or to the material properties of the respective used interleaved sheet material.

The drive can comprise a common drive shaft for all the material webs and, at the drive shaft, a separate conveying roller for each material web, with a clutch being respectively active between the conveying rollers and the drive shaft.

Provision is preferably made that the conveying rate of the drive is coordinated with the rolling off of the material webs from the material rolls such that all the material webs are always held under tension. It is hereby ensured that the web length starting from the conveying device per time unit is dependent on the roll-off rate such that a change in the roll-off rate can without delay have the result of a corresponding change in the web length starting from the conveying device per time unit.

A constant value can be predefined or predefinable for the conveying rate of the drive.

The constant value can be larger than the largest roll-off rate expected for the respective application. In this case, the conveying rate of the drive of the conveying device is smaller than the web length starting from the conveying device per time unit since more material cannot be conveyed per time unit than is rolled off from the material roll.

If a conveying rate is therefore spoken of in connection with the web length actually starting from the conveying device per time unit, then this conveying rate is identical with the roll-off rate in an operation of the interleaver or underleaver in accordance with the intended purpose with the material web between the material roll and the conveying device being under tension.

If the material web between the material roll and the conveying device is at least temporarily not held under tension, but rather has a deflection, the material length starting from the conveying device per time unit can at least temporarily be smaller than the roll-off rate, at least when the conveying rate of the drive of the conveying device is smaller than the roll-off rate at this time.

The conveying rate of the drive of the conveying device can be variable in time and can in this respect be settable in dependence on a measure which can be derived from one or more of the roll-off rates.

In accordance with a further embodiment, the drive of the conveying device can be switched off when no roll-off drive is in a driving state any longer and can be switched back on as soon as at least one roll-off drive transitions back into a driving state.

Provision can furthermore be made that the drive of the conveying device is controllable by an internal or external control device in dependence on the roll-off rates of the individual material webs in order to change the conveying rate.

The conveying device can have a conveying roller or removal roller for each track, which conveying roller or removal roller cooperates with a separate counter-roller or pressing roller or with a counter-roller or pressing roller common to all the conveying rollers or removal rollers. A secure contact of the material webs can hereby be ensured. Alternatively, a plurality of counter-rollers or pressing rollers arranged next to one another in the transverse direction can be provided for each conveying roller or removal roller. Other means for pressing can also be provided.

The invention additionally relates to an apparatus for the multitrack provision of web-like interleaved sheet material at a cutting region in which products supplied on multiple tracks are simultaneously cut into slices and interleaved sheets are introduced which are cut off from the provided interleaved sheet material in the cutting region, having a material store which comprises a common rotatably supported material roll for at least two tracks, with a device for dividing the material web into a plurality of individual material webs being provided for the material web of the common material roll; and having a removal device for the rolling off of the material web from the material roll.

In accordance with this independent aspect of the invention (which can be combined with any of the afore-mentioned embodiments), a general multitrack design of the interleaver or underleaver, albeit not provided throughout from the beginning to the end, can consequently also be implemented in that a common rotatably supported material roll is provided for a plurality of tracks. A plurality of individual material webs are produced by means of a division device from the material web rolled off from this material roll. The division device can generally be arranged at any desired position within the interleaver or underleaver.

If only a single material roll is provided for at least two tracks, an operation of the removal device individually per track can obviously not take place with respect to the rolling off of the material web from this material roll by means of the removal device. If, however, more than one material roll is provided, the rolling off of the material webs can take place individually per track to the extent that each material roll is considered as a "track" here. However, in the sense of a uniform terminology, this should not be called a rolling off individually per track, but rather a rolling off individually per roll or individually per web. When this terminology is used, the removal device for the plurality of material rolls is then consequently configured for a rolling off of the material webs individually per roll or individually per web. This is meant when an operation of the removal device "individually per track" is spoken of in connection with this aspect of the invention. If e.g. two material rolls are provided whose material webs are each e.g. divided into two individual material webs, then these two pairs of individual material webs can be handled individually with respect to the rolling off.

However, a rolling off of material webs from a plurality of material rolls only individually per roll or individually per web, with the rolled-off material webs each subsequently being divided into a plurality of individual material webs, does not preclude that these individual material webs, which are respectively associated with a track, are handled individually per track in another respect.

If a multitrack slicer is provided with an interleaver or underleaver in accordance with the invention, a common control device is preferably provided which is configured to coordinate the slicing of the products and the provision of the interleaved sheet material individually per track.

Figure 2:
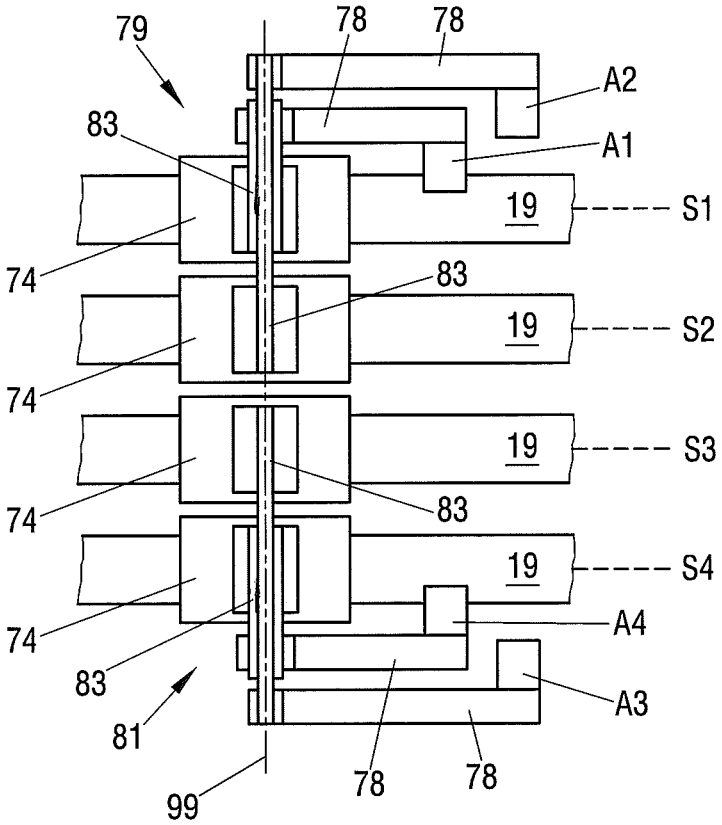
Figure 4:
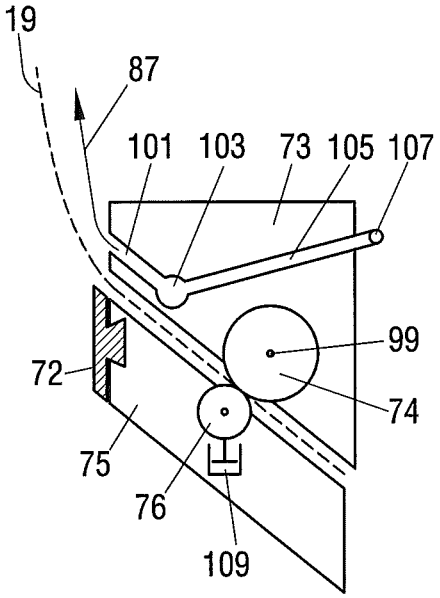
Figure 4:
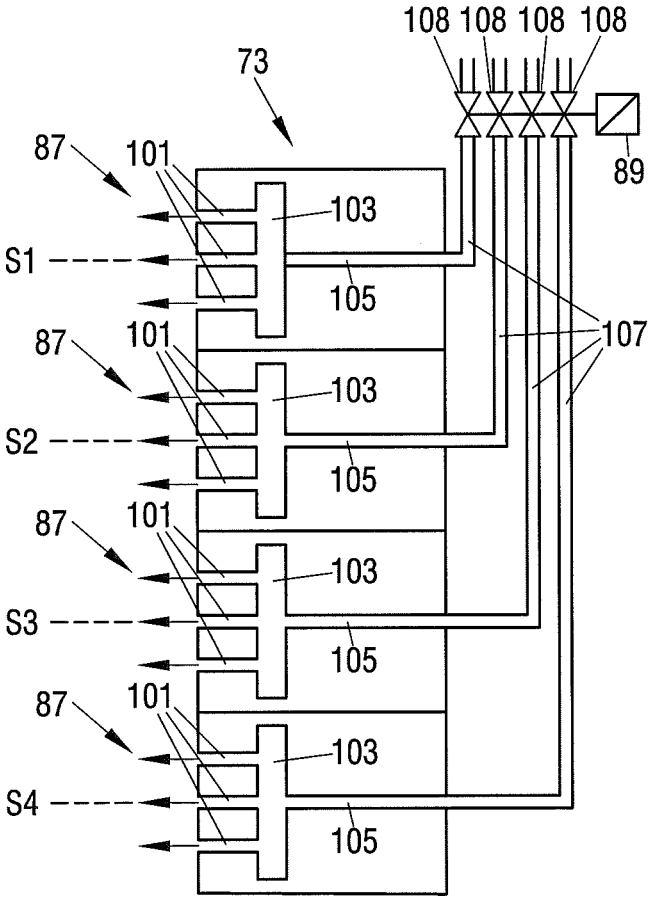
Figure 3:
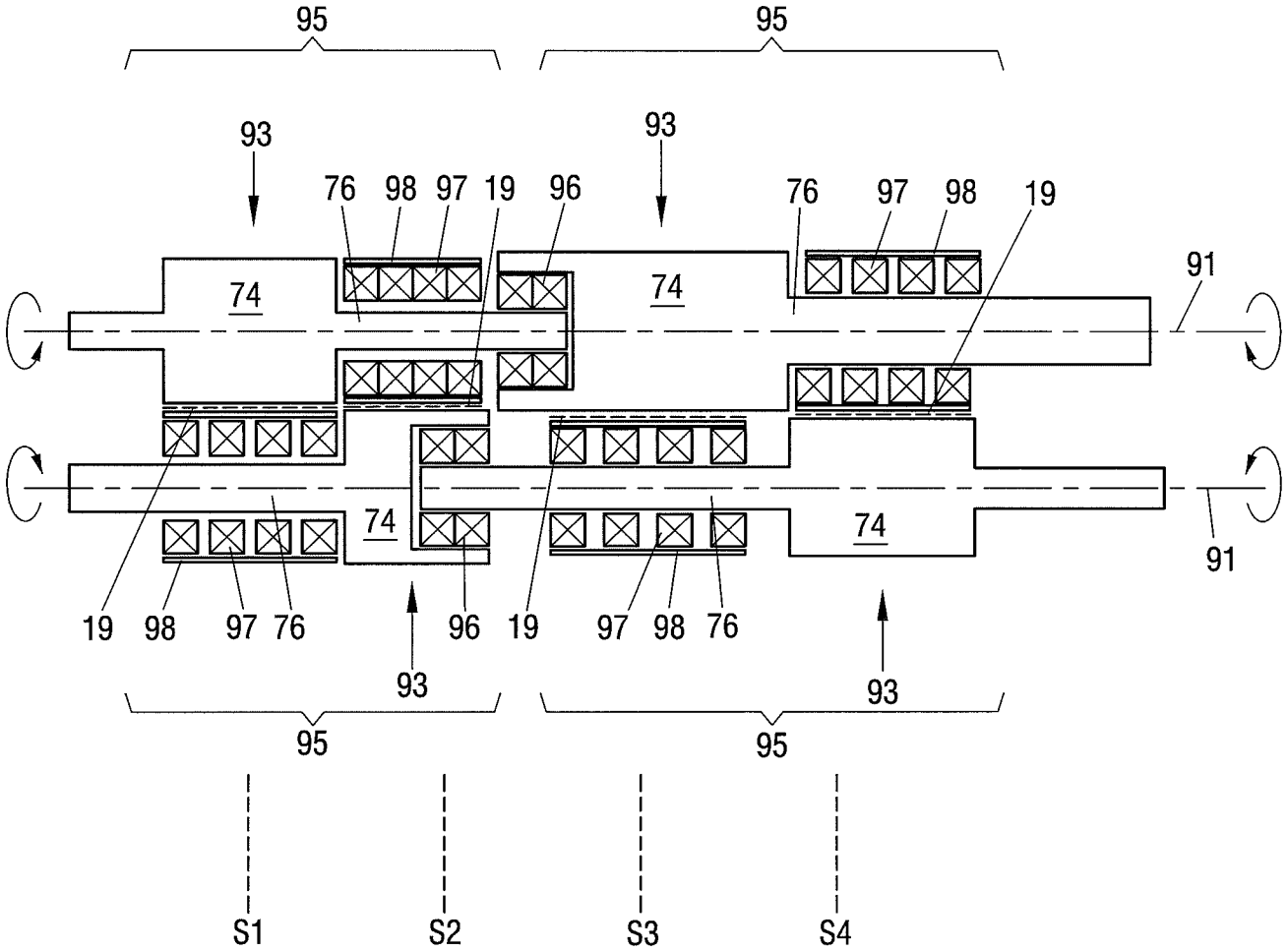

The invention will be described in the following by way of example with reference to the drawing. There are shown:

FIG. 1 schematically, a side view of a slicer with an interleaver in accordance with an embodiment of the invention and three individual representations shown schematically; and FIGS. 2-4 schematically in each case, an embodiment of a feed unit of an interleaver.

The large representation in FIG. 1 shows a multitrack high-speed slicer, that is an apparatus for a multitrack slicing of food products such as sausage, meat or cheese, in a schematic side view which is not to scale.

In the embodiment shown, the slicer is operated on four tracks. Four products 11 to be sliced are disposed next to one another on a product support 53 inclined to the horizontal. A product feed 49 comprises for each track, that is for each of the four products 11, a product holder 46, also called a product gripper, which holds the product 11 at the rear end and supplies it in the supply direction indicated by the arrow to a cutting plane 50 which extends perpendicular to the product support 53 and in which a cutting blade 51 moves by whose cutting edge the cutting plane 50 is defined.

The cutting blade 51 can be a so-called scythe-like blade or spiral blade which has a cutting edge extending in a scythe-like form or spiral form and which only rotates about a blade axis, not shown. Alternatively, the cutting blade 51 can be a so-called circular blade which has a circular cutting edge, which rotates about its own blade axis and which additionally revolves in a planetary motion about an axis extending offset in parallel from the blade axis in order to produce the cutting movement relative to the products 11 required to cut off slices 13 from the products 11.

The product feed 49 can be operated individually per track, i.e. the product holders 46 can generally move independently of one another in the supply direction and thus supply the individual products 11 to the cutting plane 50 at different speeds and with different speed profiles. This also applies if product support belts which are drivable individually per track are used instead of a passive product support 53 as the product feed 49 instead of the product holders 46 or in addition to the product holders 46. The slicing process can hereby be individually controlled in each track independently of the respective other tracks, in particular with the aim of an exact weight production of slices 13 or portions formed from a respective plurality of slices 13 while taking into account the individual product properties such as in particular weight distribution and cross-sectional profile.

It is also possible to stop the product holder 46 in a track or to move it against the supply direction in order temporarily not to cut off any slices 13 from the respective product 11 while the products 11 continue to be sliced in the other tracks. The product feed 49 on individual tracks can also take into account the cutting movement of the cutting blade 51 which is characterized in that a respective slice 13 is indeed cut off from all the products 11 per cutting movement—that is per revolution or rotation of the cutting blade 51—but this does not take place at the exact same time, the cut-off slices 13 of the products 11 rather falling onto the support surface, formed by a so-called portioning belt 55 here, consecutively in time due to the passage of the cutting blade 51 through the products 11 which requires a specific duration of time.

For many products 11, for example ham or some types of cheese, it is desired for the respective slices 13 which are disposed above one another and, for example, form a stack-like portion or an overlapping portion to be separate from one another so that they can later be individually removed more easily by a consumer from a package including the portion. In the field of high-speed slicers, this purpose is served by so-called interleavers, that is apparatus for the provision of web-like interleaved sheet material, by means of which it is possible to introduce interleaved sheets 15 between directly consecutive slices 13.

There are interleavers in different designs. In accordance with a widespread mode of operation, which is also provided for the interleaver in accordance with the invention shown here, the endless material webs 19 are ejected in the region of the cutting plane 50 coming from below in accordance with the clocking predefined by the cutting movement of the cutting blade 51. This takes place such that the front end of the respective material web 19 is disposed in front of the cut surface of the respective product 11 and, together with the slice 13 which is cut off next, is cut off from the material web 19 by means of the cutting blade 51 and thus forms an interleaved sheet 15. This interleaved sheet comes to lie on the portioning belt 55 or on the previously cut-off slice 13 and beneath that slice 13 with which the interleaved sheet 15 was previously cut off together.

The design and the mode of operation of such slicers and also the basic principle of an interleaver are sufficiently known to the skilled person so that it is not necessary to look at them in any more detail in the following.

The interleaver in accordance with the invention which is integrated into the slicer is of multitrack design and is configured to continuously provide the interleaved sheet material on individual tracks. The design and the mode of operation of the interleaver will be explained in the following using the example of a four-track operation. The interleaver in accordance with the invention can, however, also be operated on one track, on two tracks or on three tracks by a comparatively simple conversion. The respective operating mode is, for example, dependent on the products to be sliced, on the conveying and sorting devices connected downstream and on the type of packaging or on the packaging machine. The interleaver in accordance with the invention is generally designed such that an operation with any desired number of tracks and consequently also with more than four tracks is possible.

For each of the four tracks S1, S2, S3 and S4, the provision of the interleaved sheet material comprises the removal of the material from a material store formed by a material roll 17, the storage of material in a loop store 61, the guidance of the material in a region between the loop store 61 and an output device 71, and the outputting of the material by means of the output device 71.

For each track, the removal of the material web 19 from the material roll 17 comprises the rolling off of the material web 19 by means of a roll-off drive 21 and the conveying of the material web 19 into the loop store 61 by means of a conveying device 23 common to all the tracks. The individual roll-off drives 21 and the common conveying device 23 form a removal device of the interleaver in accordance with the invention.

For each track, the storage of the material web 19 takes place by the formation of a material loop 20 in the loop store 61. The individual material webs 19 or loops 20 are laterally guided by dividing walls (not shown) in the loop store 61 to ensure the accuracy of the material webs 19 on the tracks.

In the embodiment shown, the total transport path for the material web 19 between the loop store 61 and the output device 71 is formed by a shaft 111 in which the individual material webs 19 are guided. Such a design is indeed possible in practice. However, further devices which will not be looked at in any more detail at this point are preferably provided between the loop store 61 and the output device 71 in addition to a purely guidance section such as is formed by the shaft 111 in FIG. 1.

The outputting of the individual material webs 19 respectively comprises the removal of the material web 19 from the loop store 61 and the ejection of the material web 19 into the cutting region, that is before the cut surface of the respective product 11, as explained above. The material web 19 is pulled from the loop store 61 on the removal. The material web 19 is in this respect simultaneously advanced into the cutting region and is thus ejected.

These individual regions of the interleaver in accordance with the invention, that is the removal device comprising the individual roll-off drives 21 and the common conveying device 23, the loop store 61 and the output device 71, will be described in more detail in the following. If not otherwise stated, the respective description of the function and design applies to each of the individual tracks.

The interplay of these individual functional units of the interleaver with one another and also the interplay of the interleaver with the functional units of the slicer, in particular—but not exclusively—with the cutting blade 51 and with the product feed 49, is controlled by a control device 39 which can be the central control device of the slicer and thus a control device which is external with respect to the interleaver. Alternatively, the interleaver can have an internal control device which cooperates with a control device of the slicer.

Furthermore, the interleaver can additionally receive external signals e.g. from a camera system which monitors the portions produced by means of the slicer or the portion formation from the cut-off slices.

The material rolls 17 of the individual tracks are rotatably supported about a common axis of rotation 33 defined by a common mandrel. Each material roll 17 comprises a roll core 113 at which the material web 19 is wound. The material rolls 17 are freely rotatable at the mandrel to the extent that the rotational drive for the material rolls 17 for the rolling off of the material webs 19 does not takes place via this common mandrel.

Instead, a separate roll-off drive 21 is provided for each material roll 17. Each roll-off drive 21 comprises a drive arm 27 pivotable about a pivot axis 28. Each drive arm 27 comprises a support, not shown, to whose one end a drive roller 30 is attached and to whose other end a deflection roller 32 is attached. An endless belt 25 revolving around the drive roller 30 and the deflection roller 32 serves as a drive member for the material roll 17; it is configured as a friction belt and serves to cooperate in a force-transmitting manner with the wound material web 19 of the material roll 17 via the turn facing the material roll 17.

As is also shown in the schematic representation at the top right in FIG. 1, each drive roller 30 is rotationally fixedly connected to a drive shaft 31 which can be set into rotation by means of a drive motor M via a drive belt 24 in order to drive the friction belt 25 and to roll the material web 19 off from the material roll 17 in this manner.

Since the four tracks S1, S2, S3 and S4 of the interleaver extend in parallel and four material rolls 17 are thus also seated next to one another on the common mandrel, the four drive arms 27 are accordingly arranged offset from one another in the transverse direction. This is indicated in the schematic representation at the top right in FIG. 1 by the association of the tracks S1 to S4 with the individual drive rollers 30 of the drive arms 27.

The spatial arrangement of the drive arms 27 and the manner of the rotational drive for the drive rollers 30 are particularly advantageous. The axes of rotation 29 of the drive shafts 31 and thus of the drive rollers 30 each coincide with the pivot axis 28 of the respective drive arm 27. In this respect, a single common pivot axis 28 is not provided for all the drive arms 27. Instead, the drive arms 27 are combined pair-wise, wherein a common pivot axis is provided for each pair. Two drive arms 27 pivotable about an upper pivot axis 28 are in this respect associated with the tracks S1 and S3, whereas two drive arms 27 which are pivotable about an lower pivot axis 28 are associated with the tracks S2 and S4.

In the embodiment shown, all the drive arms 27 have the same length and the upper pivot axis 28 and the lower pivot axis 28 are disposed at a circular cylinder about the common axis of rotation 33 of the material rolls 17. Alternatively, the drive arms 27 can be of different lengths and the pivot axes 28 can be arranged in a different manner.

A respective coaxial shaft drive 35 or 37 is provided for both the upper pair of drive arms 27 and the lower pair of drive arms 27. The two drive motors M1 and M3 belong to the upper coaxial shaft drive 35, whereas the lower coaxial shaft drive 37 comprises the two drive motors M4 and M2. A motor M3 or M4 respectively is connected to an inner drive shaft 31 for the drive roller 30 which is disposed further away axially, whereas the respective other motor M1 or M2 is connected to a hollow shaft 31 which surrounds the inner drive shaft 31 and on which the more closely disposed drive roller 30 is seated.

As already mentioned, the drive motors M1 to M4 are not directly connected to the drive shafts 31, but rather via drive belts 24. This enables a displaced or an offset positioning of the motors and consequently an ideal use of the space available in the interleaver. Furthermore, the interleaver can hereby be designed comparatively narrow since the motors M1 to M4 respectively do not need to be positioned in the axial extension of the drive shafts 31.

A further advantage of this drive concept comprises all of the motors M1 to M4, including the drive belts 24, only being arranged at one side of the interleaver. This region is therefore more easily accessible via the other side of the interleaver. It is particularly advantageous that all the drive rollers 30, and thus the drive arms 27, can be plugged onto the respective drive shaft 31 and can be removed from it from the same side—namely starting from the "preferred" operating side. This not only facilitates cleaning and servicing, but also enables a simple and fast conversion, for example, when a slicer and interleaver operation should be converted to a different number of tracks.

These advantages also apply to the arrangement of the material rolls 17 which can all be plugged onto the common mandrel and can be removed from it from the same side—and indeed from the same side as the roll-off drives 21. It is therefore sufficient if the functional regions of the interleaver are only accessible from one side.

A pivot drive, not shown, is additionally provided for each drive arm 27. The pivot drive can, for example, comprise a piston-in-cylinder arrangement. The drive arms 27 can hereby each be pivoted into a passive state in which the friction belt 25 is out of frictional engagement with the material roll 71. This passive state can, for example, be a parked position into which the drive arms 27 are pivoted when new material rolls 17 are to be inserted.

The fact that in accordance with the invention the respective friction belt 25 of the roll-off drives 21 engages in a force-transmitting manner at the outer periphery of the material roll 17 to roll off the material web 19 has the advantage that the roll-off rate, i.e. the web length rolled off per time unit, is independent of the current diameter of the material roll 17 and thus of its degree of consumption. The above-mentioned pivot drives (not shown) can each pretension the drive arm 27 in the direction of the axis of rotation 33 of the material roll 17 with a predefined force or with a predefined torque such that the drive arm 27 is adjusted to track the diameter of the material roll 17, which decreases during operation, and the frictional engagement between the friction belt 25 and the wound material web 19 is always of the same magnitude.

A material roll 17 which is almost consumed and whose diameter is only a little larger than the diameter of the roll core 113 is shown by a dashed circle. An upper drive arm 27 and a lower drive arm 27 are shown by a dashed line to illustrate a state pivoted correspondingly far in the direction of the axis of rotation 33 of the material rolls 17.

The operation of the roll-off drives 21 depends on demands of the central control device 39. If less material or temporarily no material is required in a track, the roll-off rate of the respective track can be correspondingly changed by reducing the revolution speed of the friction belt 25 or by switching off the drive motor M. In a non-driving state with the drive motor M switched off, the frictional belt 25 of the respective drive arm 27 remains in frictional engagement with the wound material web 19; it is therefore not, for instance, pivoted out of engagement with the material roll 17 by means of the above-mentioned pivot drive (not shown). This has the advantage that the frictional belt 25 is active as a brake for the material roll 17, whereby a further rotation of the material roll 17 caused by inertia is prevented.

The removal of the material webs 19 from the material rolls 17 not only comprises the rolling off by means of the above-explained roll-off drives 21, but also the conveying of the material webs 19 into the loop store 61. For this purpose, the removal device comprises a conveying device 23 which is additionally shown schematically at the top of FIG. 1 at its center.

The conveying device 23 comprises a conveying roller 47 for each track S1 to S4, said conveying roller forming a conveying gap for the respective material web 19 together with a counter-roller 48. All of the conveying rollers 47 are seated on a common drive shaft 45, that is they are only driven together, and indeed via a common drive motor 41 which sets the common drive shaft 45 of the conveying rollers 47 into rotation via a drive belt 42.

The operation of this conveying device 23 individually per track is achieved in that a slip clutch 43 which is arranged between the conveying roller 47 and the common drive shaft 31 is associated with each conveying roller 47. The slip clutches 43 are each magnetic clutches whose switching points can be set.

The conveying device 23 is operated via the control device 39 such that the material webs 19 are each always held under tension between the respective material roll 17 and the respective conveying roller 47. During operation, the common drive shaft 45 can rotate at a constant rotational speed which is coordinated with an expected operation of the interleaver for the respective cutting program of the slicer. If the roll-off drive 21 is stopped in a track or if the roll-off rate is reduced in a track, an active intervention in the operation of the conveying device 23 is not required since a roll-off rate in a track that falls below the conveying rate of the conveying device 23 is taken up by the clutch 43 of this track without the respective material web 19 being excessively strained or even tearing.

An advantage of this concept comprises the conveying device 23 only requiring a single drive comprising a drive motor 41 and a drive belt 42 and only requiring a single common drive shaft 45 for all the tracks S1 to S4 and no design or technical control measures being necessary to implement an active operation of the conveying device 23 individually per track.

If the clutch 43 is not currently active in one of the tracks and temporarily no material is thus conveyed into the loop store 61 in this track, the conveying rate of the conveying device 23 determines the web length entering the loop store 61 per time unit in each track. Since the operation of the individual roll-off drives 21 which is controlled via the control device 39 ultimately decides whether and how much material is roiled off from the respective material roll 17 per time unit in the individual tracks, the individual conveying rates into the loop store 61 are ultimately determined by the individual roll-off rates.

The track-specific material requirement in the cutting region is determined by the control device 39 and is ensured by a corresponding track-specific control of the roll-off drives 21. The loop store 61 ensures a decoupling in each track between the sluggish material roll 17, on the one hand, and the highly dynamic output device 71, on the other hand, which, in the cycle of the cutting blade 51, has to output a web length corresponding to the length of the respective required interleaved sheet 15, in each case on short notice. Such a highly dynamic cyclic ejection of relatively long material sections would be incompatible with a pulling off of the material web 19 directly from the material roll 17.

The control device 39 therefore ensures that a web length which is sufficiently large for a disruption-free output operation of the output device 71 is available in the loop store 61 in each track at all times in that a material loop 20 which is always sufficiently large is provided in the loop store 61.

The formation and maintenance of these material loops 20 in the individual tracks is achieved by a sufficiently large "replenishment" by means of the removal device, that is by means of the roll-off drives 21 and the conveying device 23, on the one hand, and by an air circuit comprising a combined suction and blowing device 63, 65, on the other hand.

The suction side of a fan 64 belonging to this combined suction and blowing device 63, 65 is connected via a suction line 66 to a vacuum housing 68 in which a plurality of vacuum chambers 69 are formed which are separate from one another in a technical flow aspect within the housing 68. The pressure in each vacuum chamber 69 can be measured by means of sensors, not shown, and can be provided to the control device 39.

The housing 68 is bounded toward a loop region of the loop store 61 by a curved contact surface 67 in which openings are formed via which air can move from the loop region into the individual vacuum chambers 69, such as is indicated by the small arrows. The vacuum chambers 69 are each connected to the suction line 66 and thus to the suction side of the fan 64 whose pressure side is directed into the loop region, such as is indicated by the arrow in FIG. 1.

This air circuit has the effect that a designated material loop 20 is always formed and that the material web 19 contacts the contact surface 67 of the vacuum housing 68 in the designated manner. Since the material web 19 is sucked toward the contact surface 67 due to the vacuum present in the vacuum chambers 69, the contact surface 67 simultaneously serves as a brake for the material webs 19. The material webs 19 are hereby always held under a light tension, whereby the material webs 19 are prevented from compressing when the output device 71 which works in the cutting cycle pulls the material webs 19 out of the loop store 61 in a highly dynamic manner. The braking effect of the contact surface 67 or of the vacuum chambers 69 is in this respect set such that this highly dynamic removal process is not impaired.

The control device 39 can recognize by means of the mentioned pressure sensors in the vacuum chambers 69 which vacuum chamber 69 is covered by the material web 19 and which is not. A measure for the current size of the material loop 20 in the loop region of the loop store 61 can be derived from this information in a simple manner with sufficient accuracy. The material web 19 drawn as a dashed line is shown with a maximum loop size in FIG. 1. The extent of the material web 19 with a minimal loop size, in which only the uppermost vacuum chamber 69 is partly covered by the material web 19, is indicated by a dotted line.

The control 39 can activate or deactivate the individual roll-off drives 21 individually per track in accordance with the individual loop sizes determined in this manner or it can change the individual roll-off rates by a corresponding control of the motors M1 to M4 to ensure that a sufficiently large material loop 20 is present for each track at all times to maintain the above-explained decoupling between the respective track of the output device 71 and the associated material roll 17.

The output device 71 is likewise configured for an operation individually per track. For this purpose, a feed unit 73 comprises a feed roll 74 for each of the tracks S1 to S4, as will be explained in more detail in the following with reference to two possible embodiments in accordance with FIGS. 2 and 3. The feed rolls 74 have a common axis of rotation 99, wherein a separate drive motor A1, A2, A3 or A4 is provided for each feed roll 74 and cooperates via a drive belt 78 with a drive shaft 83 (cf. FIG. 2) to which the respective feed roll 74 is rotationally fixedly connected. As FIG. 2 shows, the two feed rolls 74 for the tracks S1 and S2 are driven via a right coaxial shaft drive 79, whereas a left coaxial shaft drive 81 drives the two feed rolls 74 of the other two tracks S3 and S4. The respective inwardly disposed feed roll 74 is driven via an inwardly disposed drive shaft 83, whereas the respective outwardly disposed feed roll 74 is driven via a hollow shaft 83 surrounding the inwardly disposed drive shaft 83.

In this manner, a drive individually per track of four feed rolls 74 arranged next to one another at a common axis of rotation 99 can be implemented for the feed unit 73 of the output device 71.

An alternative design for a four-track drive comprising four individually drivable feed rolls 74 is schematically shown in FIG. 3. Two axes of rotation 91 which extend in parallel are provided here, wherein a respective two two-track units 95 are arranged next to one another at each of the two axes 91. Each two-track unit 95 comprises a feed roll 74 and a pressing roller 76 which are rotationally fixedly connected to one another and which can, for example, be formed in one piece with one another. Each feed roll 74 cooperates directly with a respective material web 19, whereas the co-rotating pressing roller 76 is provided with a freewheeling function with respect to the material web 19 in its track. The freewheeling function is implemented in that the pressing roller 76 supports a freely rotatable pressing sleeve 98 for the material web 19 via a rolling element bearing 97.

A feed roll 74 at the one axis 91 and a pressing unit comprising the pressing roller 76 and the pressing sleeve 98 at the other axis 91 therefore form a pair 98 for each of the tracks S1 to S4, said pair forming a feed gap for the respective material web 19.

Each two-track unit 95 can, for example, be rotated about the respective axis 91 via a drive belt, not shown, by means of an associated drive motor (not shown), wherein the two axes 91 are driven with an opposite rotational sense. Adjacent two-track units 95 at a common axis 91 are rotatable relative to one another. For this purpose, a respective axial extension of a pressing roller 76 engages into an end-face depression of the adjacent feed roll 74 at which the extension of the pressing roller 76 is supported in the radial direction by a rolling element bearing 96.

Due to this arrangement, a feed individually per track for four tracks S1 to S4 disposed next to one another is implemented as a particularly compact unit into which the counter-units or pressing units 76, 98 associated with the individual feed rolls 74 are integrated. A division into a feed unit, on the one hand, and into a counter-unit, on the other hand, as in the embodiment in accordance with FIGS. 1 and 2, is consequently not provided here.

As FIG. 1 shows, in the embodiment shown here, a counter-unit 75 is provided in addition to the feed unit 73 comprising the four feed rolls 74 which can be driven individually per track. The counter-unit 75 can have at least one associated pressing roller 76 for each feed roll 74, which pressing roller is supported in an elastic or a resilient manner such as is indicated schematically in FIG. 1 by the suspension 77 and is indicated schematically in FIG. 4 by a piston-in-cylinder arrangement 109 configured as a suspension.

Alternatively, the counter-unit 75 can have a plurality of counter-elements arranged distributed along an axis extending in parallel with the axis of rotation 99 of the feed rolls 74, in particular counter-elements in the form of individually resiliently supported pressing rolls or pressing rollers each having a diameter which is small with respect to the feed rolls 74. These counter-elements which are not driven form a feed gap for one of the material webs 19 with each of the feed rolls 74. Such counter-units or pressing units for output devices of interleavers are generally known so that it is not necessary to look at them in more detail.

As the representation at the bottom left in FIG. 1 shows schematically, it is a special feature of the output device 71 that the feed unit 73 and the counter-unit 75 are attached to a stationary mount 70, fastened to a machine frame 115 of the slicer, together with a cutting edge 85 which is also called cutting glasses, a molded tray or a counter-blade.

The mount 70 and the components counter-unit 75, feed unit 73 and cutting edge 85 are configured corresponding to one another such that these components can only be mounted at the mount 70, without tools, in a single order.

In this respect, the counter-unit 75 is first arranged at the mount 70. The counter-unit 75 is fixed and secured in its desired position by a subsequent attachment of the feed unit 73. The attachment of the feed unit 73 requires a combined turn-pivot movement into an end position which—as indicated by the arrow in the large representation of FIG. 1—has the consequence that, on the attachment of the feed unit 73, all the drive belts 78 of the drive motors A1 to A4 are simultaneously tensioned which were previously, in the relaxed state, placed around the drive shafts 83 of the feed rolls 74 projecting at both sides. Accordingly, the drive belts 78 are automatically relaxed on the removal of the feed unit 73.

Finally, the cutting edge 85 is attached to the mount 70. The cutting edge 85 in turn positions and secures the feed unit 73 in its desired position. A clamping device 117 comprising two clamping pins 117 which are pneumatically adjustable relative to the mount 70—as indicated by the two double arrows—positions and subsequently secures the cutting edge 85 and thus all three components counter-unit 75, feed unit 73 and cutting edge 85 at the mount 70.

The mount 70 can furthermore serve for the attachment of further devices. Thus it may e.g. be necessary in practice to set the so-called cutting gap between the cutting blade 51 and the cutting edge 85 to a specific value. In this connection, sensors such as vibration sensors can be used which can be attached to the mount 70 or integrated into the mount 70.

A simple and reliable assembly and dismantling of the three named components without tools is implemented in this manner.

A query can additionally take place by the control device 39 by means of the clamping pins 117 and it can be recognized whether a cutting edge 85 is present at all and whether—in dependence on the respective set cutting program—the correct cutting edge 85 has been mounted. When a cutting edge 85 is missing, the clamping pins 117, for example, extend further than when the correct cutting edge 85 is present—this incorrect positioning of the clamping pins 117 can be recognized by the control device 39.

As already explained above, the ejection of the material web 19 by means of the output device 71 takes place such that the front end of the material web 19 is disposed in front of the cut surface of the respective product 11 so that it can be cut off from the material web 19 by means of the cutting blade 51 together with the slice 13 to be cut off next and can thus form an interleaved sheet 15.

To influence the front end of the material web 19 in this sense, a vacuum is generated by means of an air flow in the region between the material web 19 and the cut surface of the product 11 and has the effect that the front end of the material web 19 is placed against the cut surface. This concept is generally known. The air flow can e.g. be generated in that compressed air is ejected via a gap extending transversely to the material web 19 or via a plurality of openings arranged distributed in the transverse direction.

As FIG. 4 shows, in accordance with the invention, an individually variable air flow 87 is generated for each of the tracks S1 to S4 via the feed unit 73 such that the free ends of the individual material webs 19 can be influenced individually per track. The individual air flows 87 can be varied individually per track in a time regard and with respect to their strength.

This is achieved in that, for each track S1 to S4, a plurality of outlet openings are arranged distributed transversely to the respective material web 19 in the front region of the feed unit 73 above the outlet gap for the individual material webs 19 which is formed by the feed unit 73 and by the counter unit 75.

Each outlet opening belongs to an outlet passage 101 formed in the feed unit 73, with all the outlet passages 101 starting from a common distributor space 103 which is in communication with a compressed air source, not shown, via an inlet passage 105 and via a supply line 107. Each supply line 107 is provided with a controllable valve 108. The valves 108 can be controlled individually per track via an adjustment device 89.

The time behavior and the strength of the respective air flow 87 can hereby be varied for each of the tracks S1 to S4 independently of the respective other tracks.

The rail 72 also shown in FIG. 4 is a replaceable wear part which preferably comprises plastic and which serves as a cutting edge which cooperates with the cutting blade 51 on the cutting through of the individual material webs 19.

The interleaver can be configured to automatically connect consecutive material webs 19 to one another in each of the individual tracks S1 to S4. In FIG. 1, possible positions are schematically shown at which a connection device V integrated into the interleaver can be arranged.

A change device which is configured to automatically replace a respective used material roll 17 with a material roll 17 to be used is not shown in FIG. 1. The change device can be arranged outside the interleaver or can at least partly be integrated into the interleaver. A separate change device can be provided for each of the tracks S1 to S4. Alternatively, a plurality of tracks or all the tracks can have a common change device.

A multitrack design of the interleaver can also be implemented in that a common rotatably supported material roll 17 is provided for a plurality of tracks S, with a device T for dividing the material web 19 into a plurality of individual material webs 19 being provided for the material web 19 of this common material roll 17. A possible position at which such a division device T integrated into the interleaver can be arranged is schematically indicated in FIG. 1. Only one roll-off drive 21 is then provided for these tracks S, i.e. for the respective material roll 17.

In this respect, it is e.g. possible that a four-track interleaver is implemented in that two material rolls 17 are provided with which a roll-off drive 21 and a division device T are respectively associated, i.e. from whose material web 19 a respective two individual material webs 19 arise such that four individual material webs 19 move to the devices arranged downstream of the division devices T, such as in the case that a separate material roll 17, and no division device T, is provided for each track S.

Different combinations are conceivable. For example, in a four-track interleaver, a respective separate material roll can e.g. be provided for two tracks and a common material roll and a division device can be provided for two further tracks.

A handling of the individual material webs 19 individually per track in a continuous manner is consequently possible in the interleaver in accordance with the invention such that the interleaver can be operated by means of the control device 39 in dependence on the cutting process in such a manner that the interleaver operation on individual tracks can be perfectly coordinated with the cutting operation on individual tracks.

It must also be mentioned for reasons of completeness that an interleaver configured on one track or temporarily operated on one track can have a roll-off drive, such as is respectively described above for one of the tracks S1 to S4.

REFERENCE NUMERAL LIST

11 product
13 slice
15 interleaved sheet
17 material roll
19 material web
20 loop
21 roll-off drive
23 conveying device
24 drive belt
25 friction belt, drive member
27 drive arm
28 pivot axis
29 axis of rotation of the drive shafts
30 drive roller
31 drive shaft
32 deflection roller
33 axis of rotation of the material rolls
35 upper coaxial shaft drive
37 lower coaxial shaft drive
39 control device
41 drive of the conveying device
42 drive belt
43 clutch
45 drive shaft
46 product holder
47 conveying roller
48 counter-roller
49 product feed
50 cutting plane
51 cutting blade
53 product support
55 portioning belt
61 loop store
63 suction device, brake
64 fan
65 blowing device
66 suction line
67 contact surface
68 housing
69 vacuum chamber
70 mount
71 output device
72 rail
73 feed unit
74 feed roll
75 counter-unit
76 pressing roller
77 suspension
78 drive belt

79 right coaxial shaft drive
81 left coaxial shaft drive
83 drive shaft
85 cutting edge
87 compressed air flow
89 adjustment device
91 common axis
93 pair
95 two-track unit
96 rolling element bearing
97 rolling element bearing
98 pressing sleeve
99 common axis of rotation
101 outlet passage
103 distributor space
105 inlet passage
107 supply line
108 valve
109 piston-in-cylinder arrangement
111 shaft
113 roll core
115 machine frame
117 clamping pin
S track
M drive motor of the roll-off drive
A drive motor for the feed roll
V connection device
T division device

The invention claimed is:

1. An apparatus for a multitrack provision of web-like interleaved sheet material at a cutting region in which products supplied on multiple tracks are simultaneously cut into slices and interleaved sheets are introduced which are cut off from the provided interleaved sheet material in the cutting region, the apparatus comprising:

a material store which comprises a rotatably supported material roll for each track;

a core in each of the multiple tracks, wherein a first part of the interleaved sheet material is wound around each core to form the respective material roll; and a removal device for a rolling off of material webs individually per track from the material rolls, the removal device comprising:

a respective roll-off drive for each track, each respective roll-off drive comprising a drive member rotated by the roll-off drive, the drive member in form-fitted engagement or force-transmitting engagement with the respective material roll in an active state to roll off the interleaved sheet material from the material roll, the interleaved sheet material solely supported by the core and supported independently from the drive member.

2. An apparatus in accordance with claim 1, wherein the roll-off drives are each configured as friction drives which are in frictional engagement with the wound material web in an active state.

3. An apparatus in accordance with claim 2, wherein the friction drives are controllable such that they remain in frictional engagement with the wound material web after a transition from a driving state into a non-driving state.

4. An apparatus in accordance with claim 2, wherein the friction drive comprises a friction wheel, an arrangement of a plurality of friction wheels or at least one revolving friction belt whose one run cooperates with the wound material web.

5. An apparatus in accordance with claim 1, wherein the roll-off drive can be changed into a passive state in which the roll-off drive is out of engagement with the wound material web.

6. An apparatus in accordance with claim 1, wherein the roll-off drive comprises a pivotable drive arm, or wherein the roll-off drive comprises a pivotable drive arm having a pivot axis, the pivot axis of the drive arm coinciding with an axis of rotation of a drive shaft for a drive member of the drive arm.

7. An apparatus in accordance with claim 6, wherein pivot axes offset in parallel from one another are provided for the drive arms of the individual tracks.

8. An apparatus in accordance with claim 6, wherein the material rolls of the individual tracks are rotatably supported about a common axis of rotation and the pivot axes of the drive arms are disposed on a circle about the common axis of rotation.

9. An apparatus in accordance with claim 6, wherein the drive arms of the individual tracks are combined pair-wise or group-wise and a common pivot axis is provided for each pair or for each group.

10. An apparatus in accordance with claim 6, wherein the drive arms of the individual tracks are combined pair-wise or group-wise and a coaxial shaft drive is provided for each pair or for each group and comprises a plurality of drive shafts which are disposed coaxially in one another and which are associated with a respective one of the drive arms.

11. An apparatus in accordance with claim 6, wherein all of the drive arms can be pushed onto their respective drive shaft from the same side of the apparatus for assembly or dismantling.

12. An apparatus in accordance with claim 6, wherein a pivot drive which comprises a piston-in-cylinder arrangement is provided for each drive arm.

13. An apparatus in accordance with claim 1, wherein a belt drive comprising a drive motor arranged offset from a drive shaft is provided for each roll-off drive.

14. An apparatus in accordance with claim 1, wherein the roll-off rates of the individual material webs can be changed by changing the drive speed of the roll-off drive when the respective roll-off drive remains in engagement with the material roll or with the wound material web.

15. An apparatus in accordance with claim 1, wherein the removal of the individual material webs is controllable by an internal or external control device by an operation of the individual roll-off drives individually per track.

16. An apparatus in accordance with claim 1, wherein a conveying device is provided which comprises a common drive for all the material webs and a separate clutch for each material web.

17. An apparatus in accordance with claim 16, wherein the clutch is a clutch which engages automatically in dependence on force or on torque.

18. An apparatus in accordance with claim 16, wherein the drive comprises a common drive shaft for all the material webs and, at the drive shaft, a separate conveying roller for each material web, with a clutch being respectively active between the conveying rollers and the drive shaft.

19. An apparatus in accordance with claim 16, wherein the clutch can be set to different threshold values for the force transmission or for the torque transmission.

20. An apparatus in accordance with claim 16, wherein the conveying rate of the drive is coordinated with the rolling off such that all the material webs are always held under tension.

21. An apparatus in accordance with claim 16, wherein a constant value is predefined or predefinable for the conveying rate of the drive, or wherein a constant value is predefined or predefinable for the conveying rate of the drive, the constant value being larger than the largest roll-off rate expected for the respective application.

22. An apparatus in accordance with claim 16, wherein the conveying rate of the drive is variable in time and is in this respect settable in dependence on a measure which can be derived from one or more of the roll-off rates.

23. An apparatus in accordance with claim 16, wherein the drive of the conveying device can be switched off when no roll-off drive is located in a driving state any longer and can be switched back on as soon as at least one roll-off drive transitions back into a driving state.

24. An apparatus in accordance with claim 16, wherein the drive of the conveying device is controllable by an internal or external control device in dependence on the roll-off rates of the individual material webs in order to change the conveying rate.

25. An apparatus for a multitrack slicing of food products comprising:

a product feed which simultaneously supplies a plurality of products to be sliced to a cutting region in which a cutting blade moves in a rotating and/or revolving manner to simultaneously cut the supplied products into slices;

an apparatus for the multitrack provision of web-like interleaved sheet material at the cutting region in which products supplied on multiple tracks are simultaneously cut into slices and interleaved sheets are introduced which are cut off from the provided interleaved sheet material in the cutting region;

a material store which comprises a respective rotatably supported material roll for each track;

or a material store which comprises a common rotatably supported material roll for at least two tracks, with a device for dividing the material web into a plurality of individual material webs being provided for the material web of the common material roll;

a first part of the interleaved sheet material wound around a core to form the respective material roll; and a removal device for the rolling off of the material web from the material roll, the removal device comprising:

a respective roll-off drive for each material roll, each respective roll-off drive comprising a drive member rotated by the roll-off drive, the drive member in form-fitted engagement or force-transmitting engagement with the respective material roll in an active state to roll-off the interleaved sheet material from the material roll, the interleaved sheet material solely supported by the core and supported independently from the drive member.

26. An apparatus in accordance with claim 25, wherein a common control device is provided which is configured to coordinate the slicing of the products and the provision of the interleaved sheet material individually per track.

* * * * *